US007896612B2

(12) United States Patent
Schliemann et al.

(10) Patent No.: US 7,896,612 B2
(45) Date of Patent: Mar. 1, 2011

(54) BLOWER UNIT AND PORTABLE BLOWER

(75) Inventors: Harald Schliemann, Waiblingen (DE); Manfred Rabis, Schwaikheim (DE); Daniel Hirt, Kirchentellinsfurt (DE)

(73) Assignee: Andreas Stihl AG & Co. KG (DE)

( * ) Notice: Subject to any disclaimer, the term of this patent is extended or adjusted under 35 U.S.C. 154(b) by 821 days.

(21) Appl. No.: 11/836,412

(22) Filed: Aug. 9, 2007

(65) Prior Publication Data

US 2008/0089785 A1 Apr. 17, 2008

(30) Foreign Application Priority Data

Aug. 10, 2006 (DE) ..... 10 2006 037 460

(51) Int. Cl.
*F03B 3/16* (2006.01)

(52) U.S. Cl. ..... 415/198.1; 415/199.5; 415/211.2; 415/218.1; 415/219.1; 415/220; 415/227

(58) Field of Classification Search ..... 415/191, 415/193, 198.1, 199.4, 199.5, 208.1, 211.2, 415/218.1, 219.1, 220, 223, 227
See application file for complete search history.

(56) References Cited

U.S. PATENT DOCUMENTS

| | | | | |
|---|---|---|---|---|
| 4,683,370 | A * | 7/1987 | Petersen et al. | 392/385 |
| 5,839,205 | A * | 11/1998 | Hung | 34/97 |
| 6,367,162 | B2 * | 4/2002 | Fukumoto et al. | 34/97 |
| 6,460,272 | B2 * | 10/2002 | Cheng | 34/96 |
| 6,551,060 | B2 * | 4/2003 | Mordue et al. | 415/216.1 |
| 6,738,564 | B1 * | 5/2004 | Tung | 392/385 |

* cited by examiner

*Primary Examiner*—Igor Kershteyn
(74) *Attorney, Agent, or Firm*—Robert W. Becker; Robert Becker & Associates

(57) ABSTRACT

A blower unit for a portable blower, having a drive shaft that is rotatably driven by a drive motor. Disposed in the blower unit is an axial fan that is provided with at least one fan wheel driven by the drive shaft and at least guide wheel fixedly disposed in the housing. To achieve a simple construction and a simple manufacture, the housing has at least two housing sections and is divided approximately parallel to the axis of rotation of the drive shaft.

20 Claims, 5 Drawing Sheets

BLOWER UNIT AND PORTABLE BLOWER

The instant application should be granted the priority date of 10 Aug. 2006 the filing date of the corresponding German patent application, DE 10 2006 037 460.6.

BACKGROUND OF THE INVENTION

The present invention relates to a blower unit for a portable blower, and to a portable blower.

U.S. Pat. No. 4,413,371 discloses a portable blower having a blower unit. The fan is disposed in a cylindrical portion of the blower tube. The discharge nozzle is formed on the blower tube. The blower tube is made of metal thus increasing the weight of the blower, so that an operator quickly becomes fatigued when using the blower. Due to the geometry, manufacture of the blower tube of polymeric material is relatively expensive. Large, expensive molds are required.

It is therefore an object of the present invention to provide a blower unit and a blower that have a straightforward construction.

BRIEF DESCRIPTION OF THE DRAWINGS

This object, and other objects and advantages of the present application, will appear more clearly from the following specification in conjunction with the accompanying schematic drawings, in which.

SUMMARY OF THE INVENTION

Figure 1:
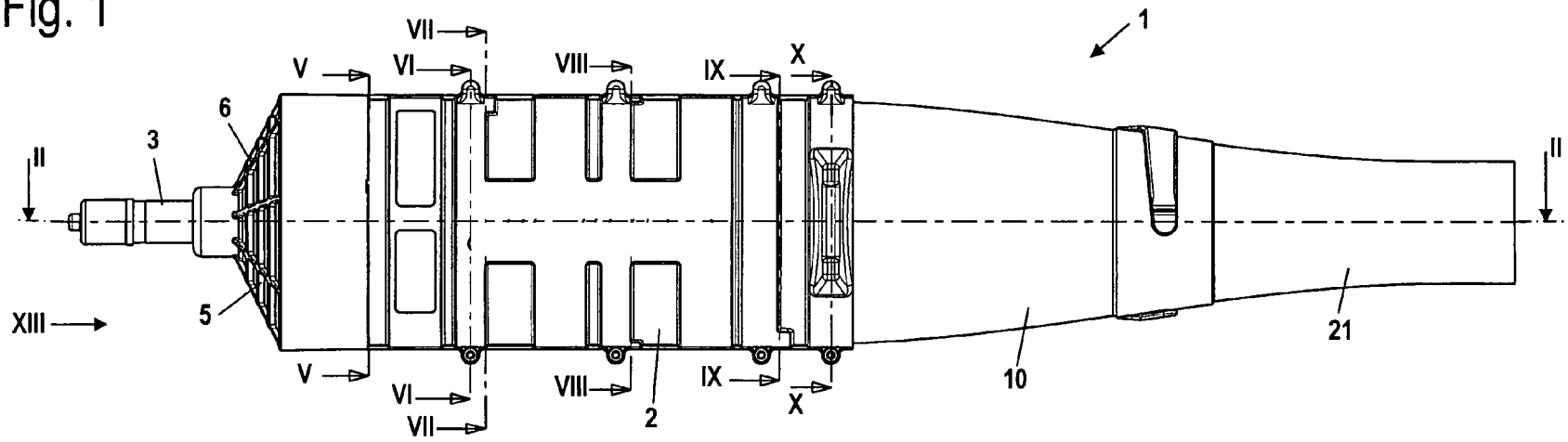
FIG. 1 shows a side view of a blower unit.

The blower unit of the present application comprises a rotatably driven drive shaft; a housing composed of at least two housing sections, wherein the housing is divided approximately parallel to the axis of the rotation of the drive shaft; and an axial fan that is disposed in the housing and is provided with at least one fan wheel driven by the drive shaft and at least one guide wheel fixedly disposed in the housing. The portable blower comprises a drive motor; a drive shaft rotatably driven by the drive motor; a blower unit that is provided with a housing, wherein the housing is composed of at least two housing sections and is divided parallel to the axis of rotation of the drive shaft; and an axial fan disposed in the housing and provided with at least one fan wheel driven by the drive shaft and at least one guide wheel fixedly disposed in the housing.

Constructing the housing from at least two housing sections simplifies manufacture of the housing. The housing shells can, for example, be easily manufactured in an injection molding process. By dividing the housing approximately parallel to the axis of rotation of the drive shaft, the blower can be easily assembled. The manufacture is simplified. Within manufacturing tolerances, the housing is advantageously divided exactly parallel relative to the drive shaft. However, it can also be advantageous for the division to deviate by several angular degrees from a parallel orientation relative to the drive shaft.

At least two housing sections advantageously have an identical configuration. The identical instruction of the housing sections represents an independent inventive concept that can also be realized with a blower unit where the housing sections are not divided parallel to the axis of rotation of the drive shaft. Due to the fact that the housing sections have an identical configuration, only a single tool is required. The storage space and the assembly are simplified.

Advantageously, two housing sections are provided that are embodied as half shells and are interconnected at a plane of separation. Due to the fact that the housing sections are embodied as half shells and are divided parallel to the axis of rotation of the drive shaft, the housing half shells can be formed without undercuts. As a result the manufacturing process can be simplified. The plane of separation in particular contains the axis of rotation of the drive shaft. As a result, the blower unit can be formed symmetrically relative to the axis of rotation.

To ensure a high stability of the housing, at least one guide wheel can support the housing sections in the interior of the housing. As a result, the wall thickness of the housing sections can be thin. Despite a greater stability, the weight of the blower unit is reduced. The guide wheel advantageously has an outer ring that rests on the inner periphery of the housing sections. The outer ring is in particular disposed in a recessed area of the housing sections that extends in the circumferential direction and secures the position of the guide wheel in the axial direction. The outer ring thus serves not only for the stabilization of the housing, but also for securing the position of the guide wheel.

The drive shaft is advantageously formed as a polygonal shaft. To achieve low bearing forces, the drive shaft can be mounted in at least two bearings, whereby in the axial direction of the drive shaft, at least one fan wheel is disposed between the bearings. Due to the fact that the drive shaft is mounted in two bearings and is not overhung mounted, the bearing forces can be reduced, and as a result the bearings can be made smaller. The weight of the blower unit is thus further reduced. A first bearing is advantageously disposed at the fan inlet, and a second bearing is advantageously disposed at the fan outlet. In this way, the bearing forces can be easily absorbed. At least one bearing is advantageously disposed on an inner ring of a guide wheel. In this connection, in particular the bearing disposed at the fan outlet is disposed on the inner ring of a guide wheel. By means of the bearing and the guide wheel, the bearing is secured relative to the housing. Due to the fact that the guide wheel serves for the mounting of the drive shaft, further components can be eliminated for mounting purposes.

Upstream of the fan inlet, the housing sections advantageously form a flow guide element, wherein the air that is drawn in flows along the outer periphery of the flow guide element. In the region of the flow guide element, the housing sections are expediently fixed in position on a guide tube of the blower. The first bearing of the drive shaft that is disposed at the fan inlet is in particular disposed on the flow guide element. To reduce the flow resistance at the fan outlet, a flow guide element can be disposed at the fan outlet, wherein air conveyed by the axial fan flows along the outer periphery of the flow guide element.

To achieve an adequate air throughout and an adequate flow velocity at the outlet out of the blower unit, the axial fan can be a multi-stage fan. The axial fan advantageously has three fan stages, each of which with a fan wheel and a guide wheel. The manufacture and assembly of the blower unit can be simplified if all of the fan wheels and all of the guide wheels of the axial fan respectively have an identical construction. This reduces the number of individual parts, that are required.

The guide wheels are advantageously angularly offset relative to one another about the axis of rotation of the drive shaft. It has been shown that by an angular offset of the guide wheels relative to one another the running noise of the blower unit can be reduced. The angular offset is advantageously approximately 360° divided by the number of guide wheel vanes divided by the number of fan stages. As a result, the guide wheel vanes are not aligned with one another. The angular offset between guide wheels disposed next to one another in the direction of flow can in this connection be a multiple of the given angular offset. However, the angular offset between the guide wheels is to be selected such that no guide wheel vane is aligned with the guide wheel vanes of another guide wheel.

To reduce the noise that results during operation, the number of the fan wheel vanes and/or the number of the guide wheel vanes can be an odd number. The number of guide wheel vanes is advantageously not the same as the number of fan wheel vanes.

The blower unit advantageously has an air outlet opening, whereby the flow cross-section in the air outlet opening is more than ¼ of a flow-through area of the fan wheel. The flow cross-section of the air outlet opening is in particular more than ⅓ of the flow-through area of the fan wheel. This results in good flow conditions that lead to a high cleaning effect of the blower unit. Favorable conditions are also achieved if the blower unit has a cylindrical portion, whereby the diameter of the cylindrical portion is approximate 0.3 to approximately 0.5 times the axial length of the cylindrical portion. The blower unit advantageously has an axial length that is approximately 2 to approximately 4 times the axial length of the axial fan. In comparison to known blower units, the overall length of the blower unit is comparatively short, and the axial fan extends over a considerable part of the axial length of the blower unit. As a result, the blower tube can be comparatively short. In this way, favorable flow conditions and at the same time low pressure losses can be realized in the blower tube.

Pursuant to the present application, a portable blower can have a drive motor, which rotatably drives a drive shaft, as well as a blower unit, whereby the blower unit has a housing in which is disposed an axial fan that is provided with at least one fan wheel driven by the drive shaft and at least one guide wheel fixedly disposed in the housing, whereby the housing is composed of at least two housing sections and is divided parallel to the axis of rotation of the drive shaft.

Due to the divided construction of the housing, the individual components can be easily positioned in the housing. A simple construction and an easy manufacture results.

At least two housing sections advantageously have an identical configuration. The two identically configured housing sections result in a simple construction of the blower. Due to the fact that the two housing sections are identical, the number of different components that have to be produced is reduced, and the storage space is simplified.

The blower expediently has an engine housing in which is disposed the drive motor. The blower in particular has a guide tube that extends from the engine housing to the fan housing. The housing sections are in particular fixed on the guide tube.

Further specific features of the present invention will be described in detail subsequently.

DESCRIPTION OF SPECIFIC EMBODIMENTS

Figure 16:
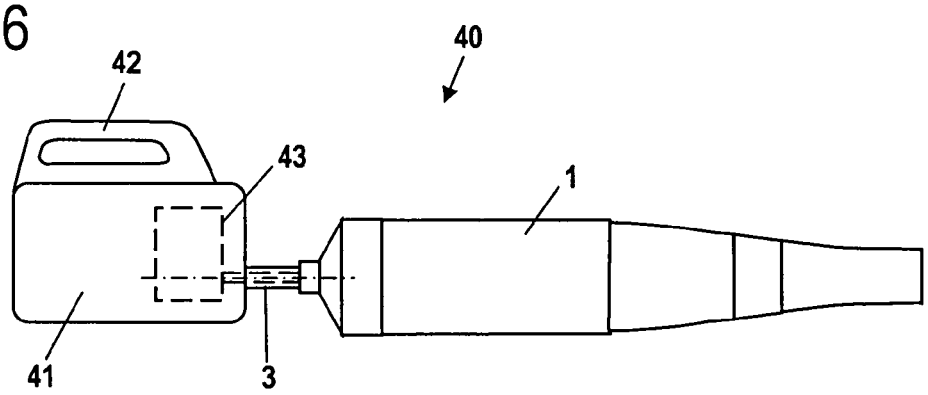
FIG. 16 is a schematic side view of a blower.

Referring now to the drawings in detail, the blower 40 shown in FIG. 16 has an engine housing 41 in which is disposed a drive motor 43, which is in particular embodied as a one-cylinder, two-cycle engine. A handle 42 is secured to the engine housing 41 for guiding the blower 40. The blower 40 has a blower unit 1, which is connected with the engine housing 41 via a guide 23.

As shown in FIG. 1, the blower unit 1 has a housing 2, out of which the guide tube 3 extends. The length i of that portion of the guide tube 3 that is formed on the blower unit 1 is advantageously more than 40 mm, in particular more than 50 mm. This enables a good connection with adjoining components, such as the housing 41 of the blower 40. The housing 2 has a cylindrical main body that on that side that faces the engine housing 41 is provided with an air inlet opening 5. The air inlet opening 5 is disposed concentrically relative to the guide tube 3, and is covered by a cover grate 6. On that side disposed remote from the engine housing 41, a blower tube 10 is secured to the housing 2; a discharge nozzle 21 for the air stream is disposed on the blower tube 10. The discharge nozzle 21 has an air outlet opening 9, which is shown in FIG. 2.

As shown in FIG. 1, the housing 2 has a cylindrical portion 51 on which the cover grate 6 is disposed. The cylindrical portion 51 has an axial length e, which is advantageously approximately 300 mm to approximately 450 mm. The cylindrical portion 51 has a diameter f, which is advantageously approximately 90 mm to approximately 200 mm. The ratio of the diameter f to the length e is advantageously in the range of from about 0.3 to about 0.5.

The blower unit 1 has an axial length g, which is advantageously approximately 800 mm to approximately 1,200 mm. The axial length g of the blower unit 1 is advantageously approximately two to approximately four times an axial length h of the axial or axial-flow fan 11. The length g is advantageously approximately three times the length h.

Figure 2:
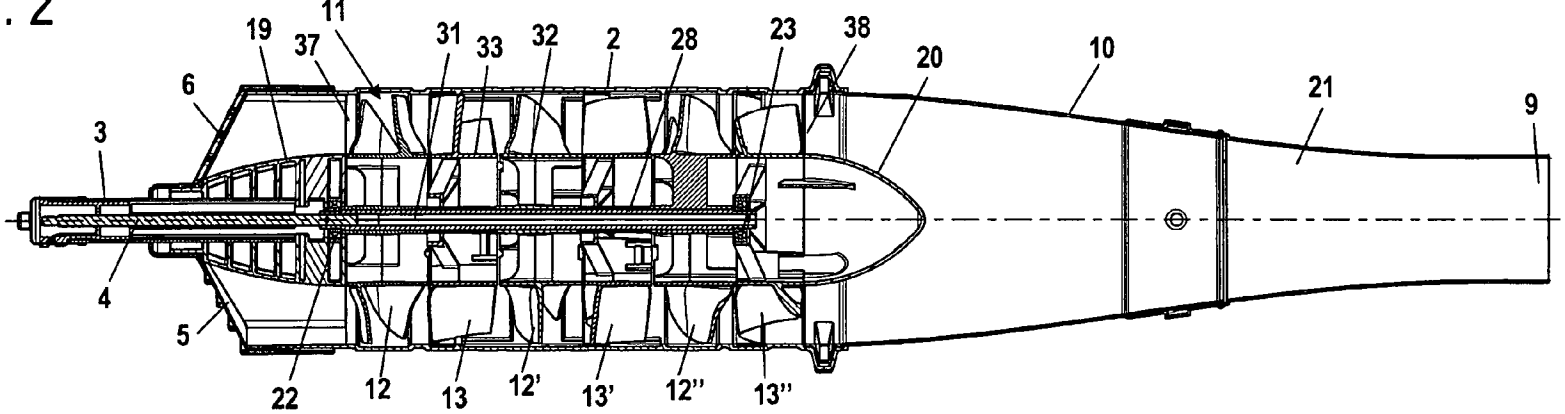
FIG. 2 is a cross-sectional view taken along the line II-II in FIG. 1.

As shown in the cross-sectional view of FIG. 2, guided in the guide tube 3 is an input shaft 4 that is rotatingly driven about an axis of rotation 31 by the drive motor 43. The input shaft 4 is connected to the drive shaft 28 in such a way that it is fixed against rotation relative thereto, so that the drive motor 43 drives the polygonal shaft 28 via the input shaft 4. The drive shaft 28 is embodied as a hollow polygonal shaft. Disposed in the housing 2 is a three-stage axial fan 11. The axial fan 11 has three fan wheels 12, 12', 12" as well as three guide wheels 13, 13', 13". Respectively paired up ones of the fan wheels 12, 12', 12" and the guide wheels 13, 13', 13" form in each case a fan stage. For a good cleaning result of the blower 40, the axial fan 11 has a diameter from 90 mm to 200 mm, in particular from 140 mm to 170 mm.

Disposed upstream of the fan inlet 37 is a flow guide element 19, around the outer periphery of which flows the air that is drawn into the axial fan 11. Disposed on the flow guide element 19 is a first bearing 22 in which the drive shaft 28 is mounted. A second bearing 23 is provided at the downstream guide wheel 13". Disposed downstream of the fan outlet 38 and of the guide wheel 13" is a flow guide element 20, along the outer periphery of which flows the air that is conveyed through the axial fan 11. The flow guide element 20 extends centrally into the blower tube 10. The fan inlet 37 designates the flow cross-section upstream of the first fan wheel 12 in the direction of flow, and the fan outlet 38 designates the flow cross-section downstream of the last guide wheel 13" in the direction of flow.

Figure 4:
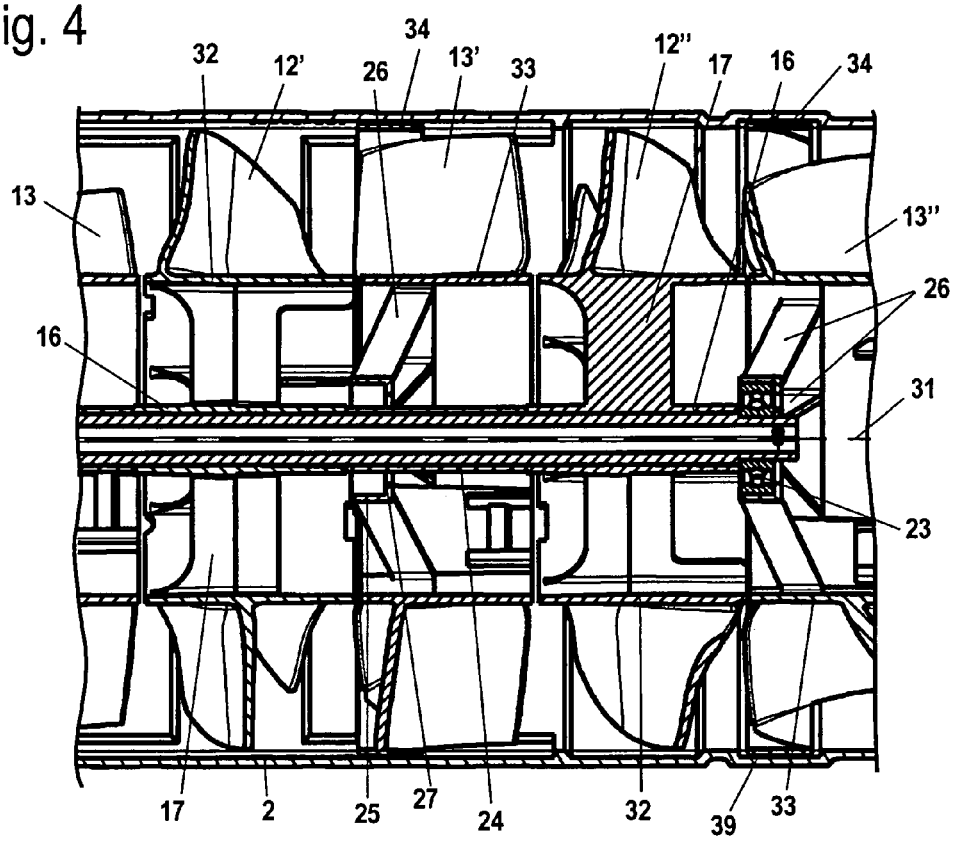
FIG. 4 is an enlarged view of a portion of FIG. 2.

As also shown in the enlarged illustration of FIG. 4, the fan wheels 12, 12', 12" have a sleeve portion 32 that has a cylindrical configuration and is arranged in the radial direction between the drive shaft 28 and the housing 2. The guide wheels 13, 13', 13" have a cylindrical sleeve portion 33, the diameter of which corresponds to the diameter of the sleeve portions 32. The diameter of the flow guide element 19 at the fan inlet 37, and the diameter of the flow guide element 20 at the fan outlet 38, correspond to the diameter of the sleeve portions 32 and 33. The sleeve portions 32 and 33 form a cylindrical chamber that is closed off at its ends by the flow guide elements 19 and 20, and in the interior of which is guided the drive shaft 28. The air conveyed by the axial fan 11 flows externally of the sleeve portions 32 and 33.

The outer diameter c of the fan wheels 12, 12', 12" is advantageously approximately 140 mm to approximately 170 mm. The outer diameter d of the sleeve portions 32, 33 is advantageously approximately 70 mm to approximately 100 mm, whereby the ratio of the outer diameter d of the sleeve portions 32, 33 to the outer diameter c of the fan wheels 12, 12', 12" is at least approximately 0.5, whereby a value of greater than 0.5 is advantageous. A flow-through area 52 is formed between the wall of the housing 2 in the cylindrical portion 51 and the sleeve portions 32 and 33. The ratio of the flow cross-section in the region of the air outlet opening 9 to the flow cross-section of the flow-through area 52 of the axial fan 11 is advantageously greater than 0.25. A ratio of greater than 0.3 is particularly advantageous. A value of about 0.37 has been established as expedient.

Figure 3:
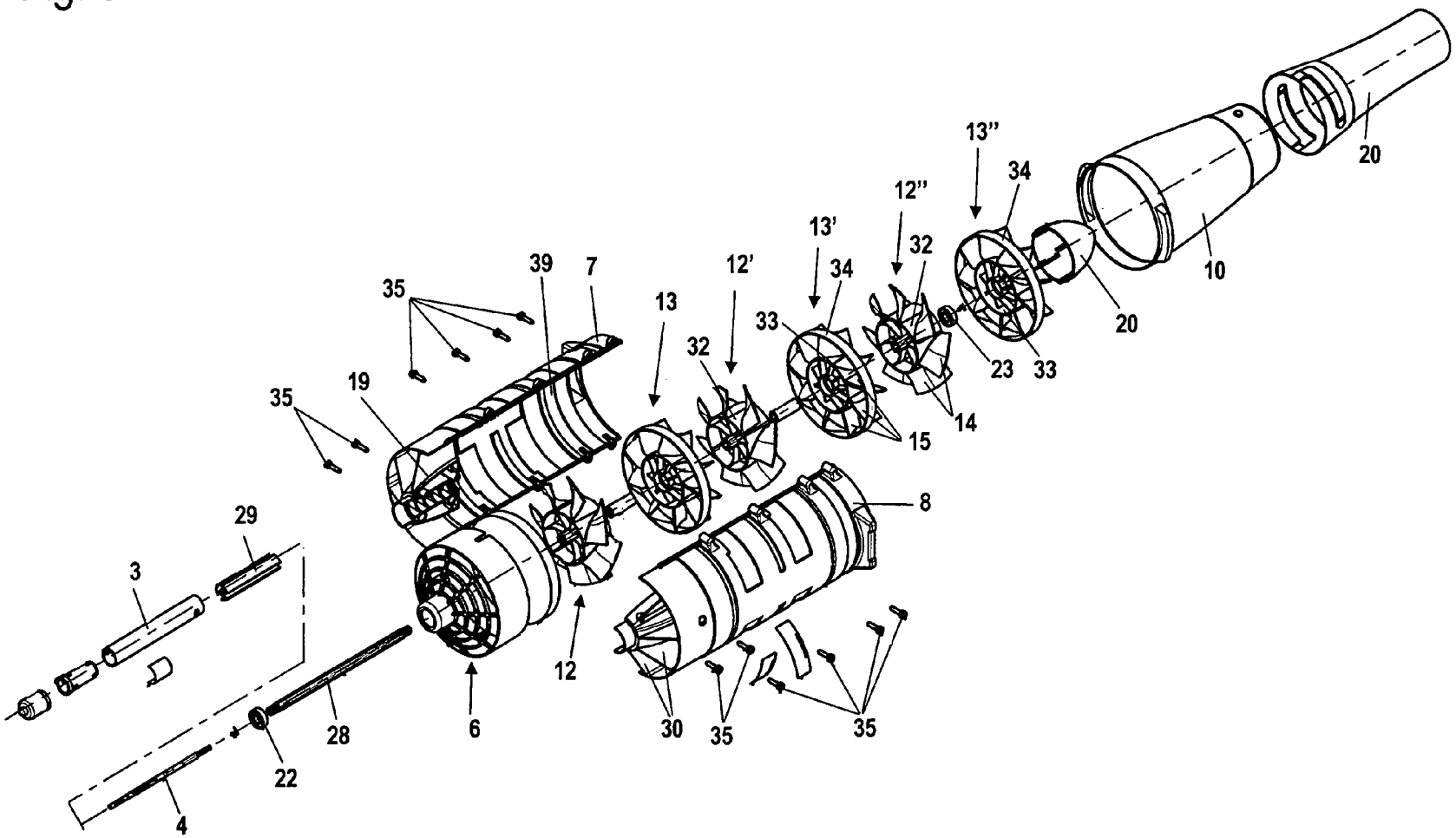
FIG. 3 is an exploded view of the blower unit of FIG. 1.

As shown in the exploded view of FIG. 3, the housing 2 is composed of a first housing section 7 and a second housing section 8. The two housing sections 7, 8 are embodied as half sections or shells that are identical to one another. The housing 2 is divided in the longitudinal direction, in other words, parallel to the axis of rotation 31 of the drive shaft 28. On sides that extend parallel to the axis of rotation 31 the housing sections 7, 8 rest against one another. The two housing sections 7, 8 are fastened to one another via screws 35. A half of the flow guide element 19 is formed on each of the housing sections 7, 8. The portions of the flow guide element 19 are connected to the respective housing section 7 and 8 via guide surfaces or fins 30.

The input shaft 4 is mounted in the guide tube 3 via a support element 29 that centers the input shaft 4 in the guide tube 3. The fan wheels 12, 12', 12" are provided with fan wheel vanes 14 on the periphery of the sleeve portions 32. Guide wheel vanes 15 are disposed on the periphery of the sleeve portions 33 of the guide wheels 13, 13', 13". On the outer periphery of the guide wheel vanes 15 each guide wheel 13, 13', 13" is provided with an outer ring 34. The flow guide element 20 at the fan outlet 38 is embodied as a monolithic component and is fixed to the downstream guide wheel 13". The two housing sections 7 and 8 are secured in position on the guide tube 3. As shown in FIG. 3, for this purpose a total of four screws 35 are provided in the region of the flow guide element 19.

As shown in FIG. 4, the outer ring 34 of the downstream guide wheel 13" is disposed in a recessed area 39 that extends on the periphery of the housing 2. The recessed area 39 secures the position of the guide wheel 13" in the direction of the axis of rotation 31 of the drive shaft 28. Radially within the sleeve portions 32 the fan wheels 12, 12', 12" are provided with spokes 17 that extend radially inwardly to a hub 16. The hub 16 has a polygonal profile, shown in FIG. 11, that cooperates with the polygonal profile of the drive shaft 28 and thus establishes a fixed connection between the fan wheels 12, 12', 12" and the drive shaft 28. A respective spacer 24 is disposed on the drive shaft 28 between two hubs 16; the axial length of the spacers 24 corresponds to the distance between two fan wheels 12, 12', 12". The guide wheels 13 and 13' are disposed radially outwardly of the spacers 24. Each of the guide wheels 13, 13', 13" is provided with an inner ring 25 that is connected with the sleeve portions 33 via spokes 26. The inner ring 25 has a lateral collar 27 that is radially spaced relative to the spacer 24. The outer rings 34 of the guide wheels 13, 13', 13" are supported on the inner periphery of the housing 2. The housing sections 7 and 8 are inter connected by the screws 35. The securement via the screws 35 secures the outer rings 34 of the guide wheels 13, 13', 13" in the housing 2. The outer rings 34 thereby reinforce the housing 2. The downstream guide wheel 13" supports the second bearing 23 for the drive shaft 28. The second bearing 23 is disposed on the inner ring 25 and is supported in the axial direction against the collar 27.

Figure 5:
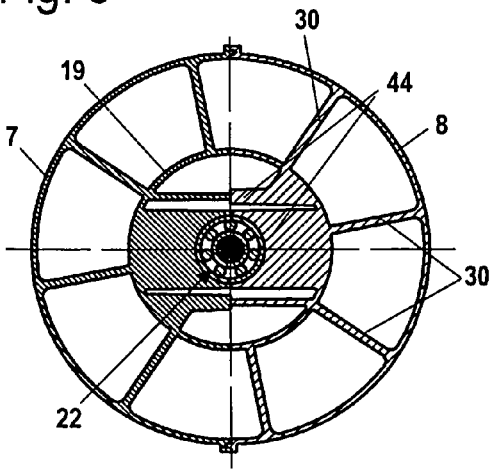
FIG. 5 is a cross-sectional view taken along the line V-V in FIG. 1.

FIG. 5 shows the arrangement of the first bearing 22 in the housing sections 7 and 8 in the region of the flow guide element 19. The interior of the flow guide element 19 is provided with struts 44 that support the bearing 22 and that reinforce the housing sections 7 and 8 in the region of the fastening effected by the screws 35. As also shown in FIG. 5, four fins 30 are provided in each housing section 7, 8 that extend radially upwardly from the flow guide element 19 to the outer wall of the housing 2.

Figure 6:
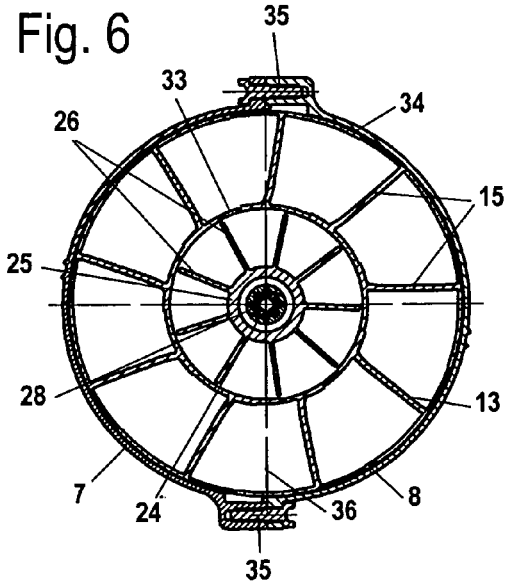
FIG. 6 is a cross-sectional view taken along the line VI-VI in FIG. 1.

FIG. 6 is a cross-sectional view through the upstream guide wheel 13. The two housing sections 7 and 8 are inter connected by screws 35. The two housing sections 7 and 8 rest against one another at a plane of separation 36. The two screws 35 shown in FIG. 6 are threaded in from opposite sides of the plane of separation 36, so that in each case a head of one of the screws is disposed on the housing section 7 or the housing section 8 respectively, and each screw is threaded into the other housing section 7, 8. The guide wheel 13 has an outer ring 34 that rests against the inner periphery of the housing 2 and supports the housing 2. The guide wheel 13 is securely held in the housing 2 via the outer ring 34. The outer ring 34 is connected to the sleeve portion 33 via guide wheel vanes 15. The sleeve portion 33 is connected with the inner ring 25 via radially inwardly extending spokes 26. The spacer 24, which surrounds the drive shaft 28, is disposed radially inwardly of the inner ring 25. As shown in FIG. 6, the drive shaft 28 is embodied as a hollow shaft that has a polygonally profiled outer periphery. The inner periphery of the spacer 24 has a polygonal profile that corresponds to the drive shaft 28. The inner ring 25 is radially spaced from the spacer 24, so that the drive shaft 28, with the spacer 24, can rotate in an unobstructed manner in the guide wheel 13.

Figure 7:
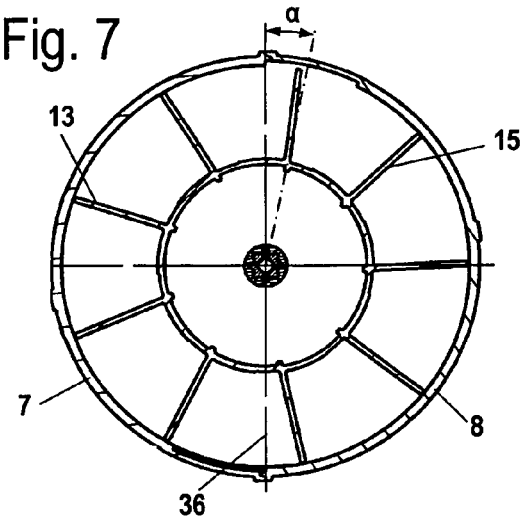
FIG. 7 is a cross-sectional view taken along the line VII-VII in FIG. 1.
Figure 8:
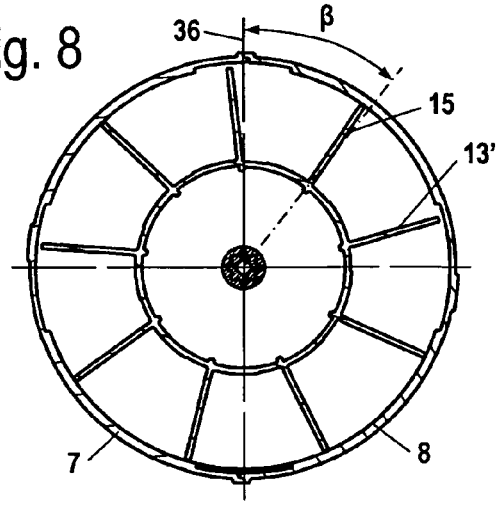
FIG. 8 is a cross-sectional view taken along the line VIII-VII in FIG. 1.
Figure 9:
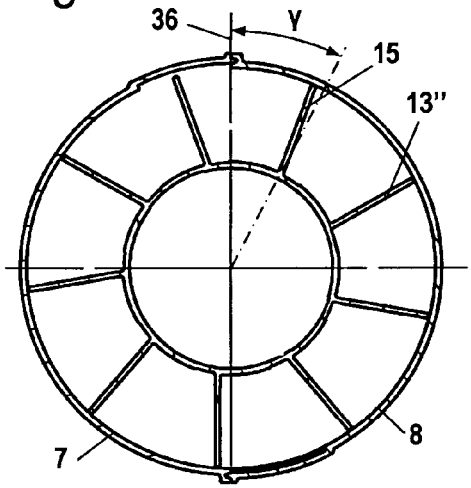
FIG. 9 is a cross-sectional view taken along the line IX-IX in FIG. 1.

FIG. 7 shows a further cross-sectional view through the guide wheel 13 downstream of the cross-section of FIG. 6. As shown in FIG. 7, the guide wheel 13 has nine guide wheel vanes 15. That guide wheel vane 15 that is disposed at the top in FIG. 7 and in a clockwise direction is disposed adjacent to the plane of separation 36 forms an angle α with the plane of separation 36. The guide wheel 13' of the second fan stage, which is disposed downstream of the guide wheel 13 of the first fan stage, has a configuration that is identical to the guide wheel 13. That guide wheel vane 15 of the guide wheel 13' that is disposed at the top in FIG. 8 and in a clockwise direction is disposed adjacent to the plane of separation 36 forms an angle β with a plane of separation 36 that is greater than the angle α. The different between the angles α and β is a multiple of 13.3°. This offset results from 360° divided by the number of fan stages, namely three, and divided by the number of guide wheel vanes, namely nine. The mathematically determined value can be rounded off so that the actual offset corresponds approximately to the mathematically determined value. As shown in the cross-sectional view of FIG. 9 through the downstream guide wheel 13", that guide wheel vane 15 that is disposed at the top of FIG. 9 and in the clockwise direction is adjacent to the plane of separation 36 is rotated by an angle γ relative to the plane of separation 36 that is between the angle α and the angle β. In the illustrated embodiment the difference between the angles β and α is twice the difference between the angles γ and α. The central guide wheel 13' is thus offset relative to the upstream guide wheel 13 by twice the angle offset, and the downstream guide wheel 13" is offset by the single angular offset. The selected angular offset ensures that none of the guide wheel vanes 15 of the guide wheels 13, 13', 13" are aligned with one another in the direction of the axis of rotation 31. As a result, the development of noise during operation is reduced. All of the guide wheels 13, 13', 13" are identical.

Figure 10:
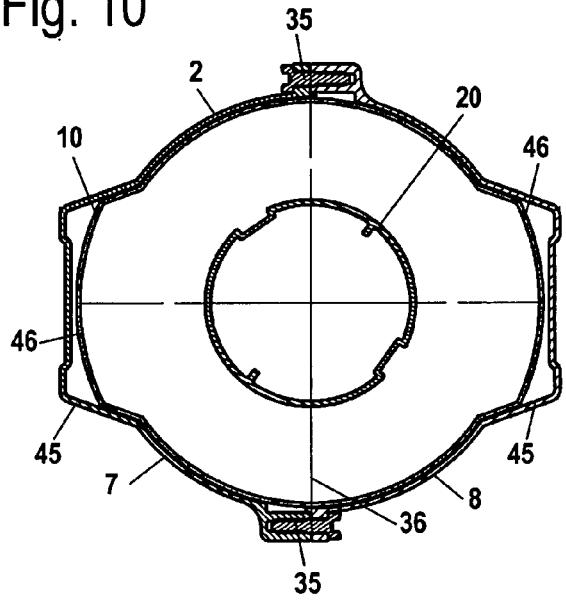
FIG. 10 is a cross-sectional view taken along the line X-X in FIG. 1.

As shown in the cross-sectional view of FIG. 10, the upstream end of the housing, in each of the housing sections 7, 8, is provided with an outwardly directed raised portion 45 into which project correspondingly shaped raised portions 46 of the blower tube 10. As a result, the position of the blower tube 10 is secured and the blower tube is held on the housing tube. Additional fastening means are not required for the blower tube 10.

Figure 11:
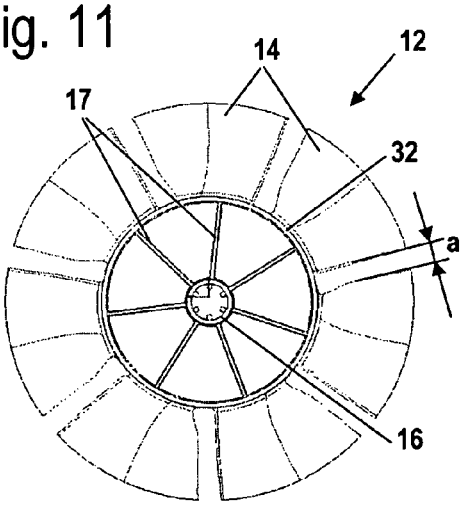
FIG. 11 is an end view of a fan wheel.

FIG. 11 shows an end view of a fan wheel 12. As shown in FIG. 11, seven fan wheel vanes 14 are disposed on the fan wheel 12. Adjacent fan wheel vanes 14 are spaced relative to one another by the distance a as measured in the circumferential direction. If the fan wheel 12 is made of polymeric material, removal from the mold can thus be easily ensured. The spacing a can, for example, be between 3 mm and 10 mm.

Figure 12:
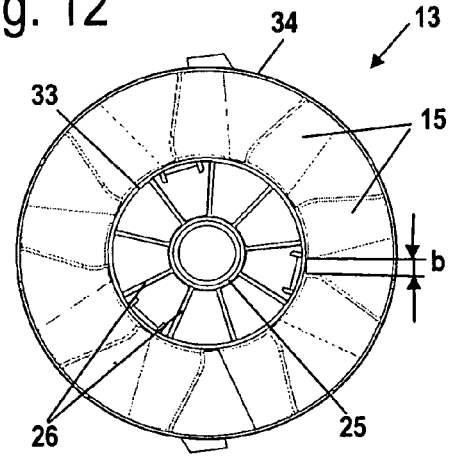
FIG. 12 is an end view of a guide wheel.

As shown in the end view of a guide wheel 13 in FIG. 12, nine guide wheel vanes 15 are disposed in a uniformly spaced-apart relationship between the sleeve portion 33 and the outer ring 34. Adjacent guide wheel vanes 15 are spaced from one another by the distance b, measured in the circumferential direction, that can correspond to the distance a between adjacent fan wheel vanes 14 and is between 3 mm and 10 mm.

Figure 13:
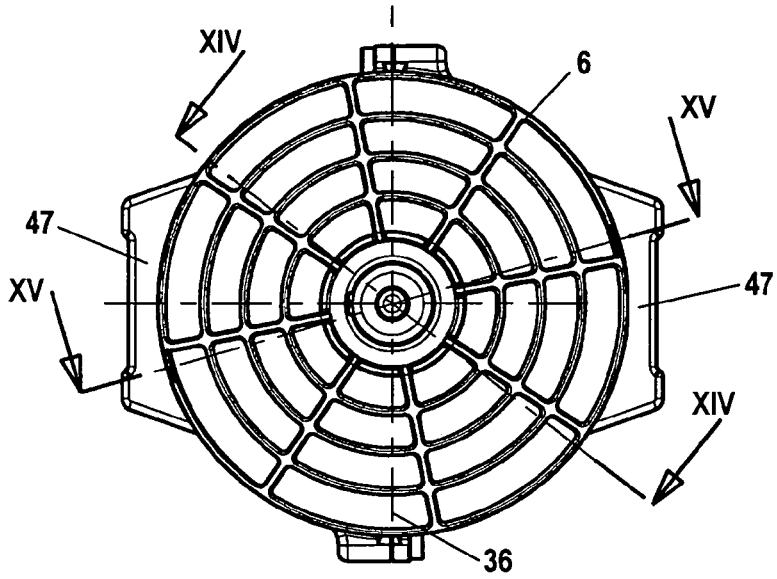
FIG. 13 is an end view of the blower unit taken in the direction of the arrow XII in FIG. 1.
Figure 14:
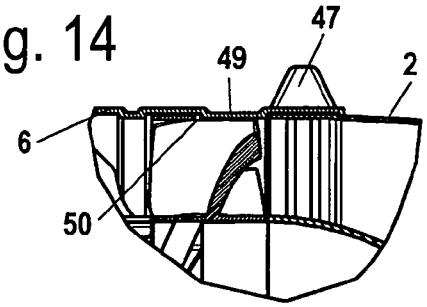
FIG. 14 is a portion of a cross-sectional view taken along the line XIV-XIV in FIG. 13.
Figure 15:
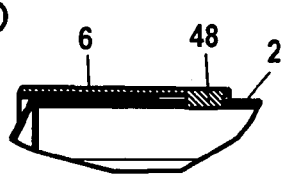
FIG. 15 is a portion of a cross-sectional view taken along the line XV-XV in FIG. 13.

FIGS. 13, 14, and 15 show the fixation of the cover grate 6 on the housing 2. As shown in FIG. 13, the cover grate 6 is provided with latching elements 47 on which is disposed the inwardly projecting latching rim 48 that is shown in FIG. 15. The latching rim 48 cooperates with the housing 2 and thus fixes the cover grate 6 on the housing 2. As shown in FIG. 14, additionally provided on the cover grate 6 are recessed areas 49 that extend into cutouts 50 of the housing 2 and thus fix the cover grate 6. Thus also for the fixation of the cover grate 6 no additional components are required.

As shown in FIG. 3, each fan wheel 12, 12', 12" has seven fan wheel vanes 14. Not only the number of fan wheel vanes 14 but also a number of guide wheel vanes 15 is not even. A different number of fan wheel vanes and guide wheel vanes is provided. Particularly advantageous for, reducing noise is having a number of fan wheel vanes 14 and/or a number of guide wheel vanes 15 that is a primary number. The fan wheels 12 can also be rotationally shifted relative to one another on the drive shaft 28, so that no fan wheel vanes 14 are aligned with or overlap one another. In this connection the angular offset again advantageously corresponds to 360° divided by the number of fan wheel vanes divided by the number of fan stages.

The offset of the guide wheel vanes and/or of the fan wheel vanes relative to one another represents an independent inventive concept. Similarly an independent inventive concept is that the number of the fan wheel vanes and/or the number of the guide wheel vanes is an odd number, and in particularly a primary number, and also that the number of the fan wheel vanes and the number of the guide wheel vanes are different.

The specification incorporates by reference the disclosure of German priority document DE 10 2006 037 460.6 filed 10 Aug. 2006.

The present invention is, of course, in no way restricted to the specific disclosure of the specification and drawings, but also encompasses any modifications within the scope of the appended claims.

What we claim is:

1. A blower unit for a portable blower, comprising:

a rotatably driven drive shaft;

a housing; and an axial fan disposed in said housing, wherein said axial fan is provided with a plurality of fan wheels adapted to be driven by said drive shaft, and wherein said axial fan is provided with a plurality of guide wheels fixedly disposed in said housing;

wherein said housing is composed of at least two housing sections, further wherein said housing is divided approximately parallel to an axis of rotation of said drive shaft, further wherein a flow guide element is disposed at an outlet of said axial fan, and wherein air conveyed by said axial fan is adapted to flow along an outer periphery of said flow guide element.

2. A blower unit according to claim 1, wherein at least two of said housing sections have an identical configuration.

3. A blower unit according to claim 1, wherein two housing sections are provided that are embodied as half shells and are interconnected at a plane of separation, and wherein said plane of separation contains said axis of rotation of said drive shaft.

4. A blower unit according to claim 1, wherein at least one of said guide wheels supports said housing sections in an interior of said housing.

5. A blower unit according to claim 4, wherein said at least one guide wheel is provided with an outer ring that rests against an inner periphery of said housing sections, and wherein said outer ring is disposed in a recessed area of said housing sections that extends in a circumferential direction and secures a position of said guide wheel in an axial direction.

6. A blower unit according to claim 1, wherein said drive shaft is embodied as a polygonal shaft.

7. A blower unit according to claim 1, wherein at least two bearings are provided for mounting of said drive shaft, and wherein in an axial direction of said drive shaft, at least one fan wheel is disposed between said bearings.

8. A blower unit according to claim 7, wherein a first one of said bearings is disposed at an inlet of said axial fan, and wherein a second one of said bearings is disposed at an outlet of said axial fan.

9. A blower unit according to claim 7, wherein one of said guide wheels is provided with an inner ring, and wherein at least one of said bearings is disposed on said inner ring.

10. A blower unit according to claim 1, wherein upstream of an inlet of said axial fan said housing sections form a flow guide element, and wherein air that is drawn into said blower unit is adapted flow along an outer periphery of said flow guide element.

11. A blower unit according to claim 10, wherein in a region of said flow guide element said housing sections are fixed in position on a guide tube.

12. A blower unit according to claim 10, wherein a bearing is disposed at said fan inlet and is disposed on said flow guide element.

13. A blower unit according to claim 1, wherein said fan wheels are provided with fan wheel vanes, wherein said guide wheels are provided with guide wheel vanes, wherein the number of fan wheel vanes and/or the number of guide wheel vanes is an odd number, and wherein the number of guide wheel vanes is not the same as the number of fan wheel vanes.

14. A blower unit according to claim 1, further including an air outlet opening having a flow cross-section that is more than ¼ of a flow-through area of said at least one fan wheel, wherein said blower unit further comprises a cylindrical portion having a diameter (f) that is advantageously approximately 0.3 to 0.5 times an axial length (e) of said cylindrical portion, and wherein said blower unit has an axial length (g) that is in particular approximately two to four times an axial length (h) of said axial fan.

15. A blower unit, for a portable blower, comprising:

a rotatably driven drive shaft;

a housing; and an axial fan disposed in said housing, wherein said axial fan is provided with at least one fan wheel adapted to be driven by said drive shaft, and wherein said axial fan is provided with at least one guide wheel fixedly disposed in said housing;

wherein said housing is composed of at least two housing sections, further wherein said housing is divided approximately parallel to an axis of rotation of said drive shaft, further wherein said axial fan is a multi-stage fan, and further wherein said guide wheels are angularly offset relative to one another about said axis of rotation of said drive shaft.

16. A blower unit according to claim 15, wherein said axial fan has three fan stages, and wherein each of said fan stages has a fan wheel and a guide wheel.

17. A blower unit according to claim 15, wherein all of said fan wheels have an identical configuration, and wherein all of said guide wheels have an identical configuration.

18. A blower unit according to claim 15, wherein said angular offset is approximately 360° divided by a number of guide wheel vanes disposed on said guide wheel and by the number of fan stages.

19. A portable blower, comprising:

a drive motor;

a drive shaft that is rotatably driven by said drive motor;

a blower unit that is provided with a housing; and an axial fan disposed in said housing, wherein said axial fan is provided with at least one fan wheel adapted to be driven by said drive shaft, and wherein said axial fan is provided with at least one guide wheel fixedly disposed in said housing; and wherein said housing is composed of at least two housing sections and is divided parallel to an axis of rotation of said drive shaft, further wherein said blower further comprises an engine housing in which is disposed said drive motor, further wherein said blower further comprises a guide tube that extends from said engine housing to said housing of said blower unit, and wherein said housing sections are fixed on said guide tube.

20. A blower according to claim 19, wherein at least two of said housing sections have an identical configuration.

* * * * *